US009149849B2

(12) United States Patent
Giacomini

(10) Patent No.: US 9,149,849 B2
(45) Date of Patent: Oct. 6, 2015

(54) STRAIGHTENING DEVICE, STRAIGHTENING PROCESS AND PROCESS FOR SETTING UP A STRAIGHTENING DEVICE

(75) Inventor: Franco Giacomini, Orebro (SE)

(73) Assignee: JOSAM AB, Orebro (SE)

( * ) Notice: Subject to any disclaimer, the term of this patent is extended or adjusted under 35 U.S.C. 154(b) by 1073 days.

(21) Appl. No.: 12/992,651

(22) PCT Filed: May 15, 2009

(86) PCT No.: PCT/SE2009/000254

§ 371 (c)(1),
(2), (4) Date: Nov. 15, 2010

(87) PCT Pub. No.: WO2009/139689

PCT Pub. Date: Nov. 19, 2009

(65) Prior Publication Data

US 2011/0067476 A1 Mar. 24, 2011

(30) Foreign Application Priority Data

May 16, 2008 (SE) ..... 0801132-2

(51) Int. Cl.
*B21D 1/12* (2006.01)
*B21D 1/14* (2006.01)

(52) U.S. Cl.
CPC ... *B21D 1/12* (2013.01); *B21D 1/14* (2013.01)

(58) Field of Classification Search
USPC ..... 72/295, 298, 311, 457, 460, 461, 705, 72/446, 447, 458; 248/352, 500, 503, 544, 248/637, 649; 269/58–60, 74, 76, 309, 311
See application file for complete search history.

(56) References Cited

U.S. PATENT DOCUMENTS

| | | | |
|---|---|---|---|
| 3,492,855 | A | 2/1970 | Cleyburn |
| 3,777,537 | A | 12/1973 | Samuelsson et al. |
| 3,888,100 | A | 6/1975 | Chisum |
| 3,955,397 | A | 5/1976 | Meis |
| 4,088,006 | A | 5/1978 | Patten |

(Continued)

FOREIGN PATENT DOCUMENTS

| | | | |
|---|---|---|---|
| EP | 0361410 | A2 | 4/1990 |
| FR | 2516410 | A1 | 5/1983 |
| GB | 2007136 | A | 5/1979 |

OTHER PUBLICATIONS

European Search Report dated Sep. 23, 2011 for application No. EP 09 74 6849, 6 pp.

*Primary Examiner* — Shelley Self
*Assistant Examiner* — Pradeep C Battula
(74) *Attorney, Agent, or Firm* — Perkins Coie LLP

(57) ABSTRACT

A straightening arrangement for straightening a chassis frame, having a plurality of bridges (11). Each bridge has a horizontal beam (12) and a vertical beam (13) whose lower end is fixed to the horizontal beam, a floor anchorage which detachably fastens the bridge to the floor, a device (15) arranged horizontally on the beam construction, and a chain attachment fitting (18). The bridge is locked in at least two directions, perpendicular to one another and also to the chassis frame. The horizontal device is arranged, in the straightening of a chassis frame which is bent in the lateral direction, to apply a horizontally directed force. The chain attachment fitting is arranged in the straightening of a chassis frame, which is bent in the vertical direction or is crooked, to secure a chain that is attached to the chassis frame.

15 Claims, 8 Drawing Sheets

(56) References Cited

U.S. PATENT DOCUMENTS

| | | | | | |
|---|---|---|---|---|---|
| 4,215,849 | A | | 8/1980 | Charland | |
| 4,574,613 | A | | 3/1986 | Doughty | |
| 4,748,842 | A | | 6/1988 | Dingman | |
| 4,823,589 | A | * | 4/1989 | Maxwell et al. | 72/457 |
| 4,827,759 | A | * | 5/1989 | Mattson | 72/705 |
| 4,836,010 | A | | 6/1989 | Papesh | |
| 4,930,333 | A | * | 6/1990 | Marbury | 72/705 |
| 4,941,343 | A | * | 7/1990 | Stancato | 72/705 |
| 5,000,634 | A | * | 3/1991 | Ducote | 410/77 |
| 6,098,445 | A | * | 8/2000 | Meis | 72/457 |
| 6,779,376 | B2 | * | 8/2004 | Linquist | 72/457 |
| 2003/0089154 | A1 | * | 5/2003 | McClellan et al. | 72/705 |

* cited by examiner

STRAIGHTENING DEVICE, STRAIGHTENING PROCESS AND PROCESS FOR SETTING UP A STRAIGHTENING DEVICE

TECHNICAL FIELD

The present invention relates in general terms to the straightening of vehicles which have been deformed, for example, in traffic accidents. The invention relates, more particularly, to a straightening arrangement and a process for straightening a chassis frame which is bent in the lateral or vertical direction or is crooked, as well as to a process for setting up a straightening arrangement.

PRIOR ART

Straightening arrangements according to the prior art comprise a number of parts which are fitted together in different ways depending on the particular application, i.e. depending on how the chassis frame and the damage look. These straightening arrangements are mounted in grooves or rails which are embedded in the floor of a workshop. The grooves are installed together with the construction of the building, or at a later stage, in which case extensive reconstruction is required.

Apart from grooves embedded in a workshop floor, fixed installations in the form of larger style ramps can be used. These installations close off a workshop area to all measures other than specifically the straightening measures for which the ramp is intended.

SUMMARY OF THE INVENTION

The assembly of the straightening arrangement according to the prior art is complicated, time-consuming and costly, since a large quantity of component parts must be fitted together for each new application or damage.

The setting-up of the floor grooves, i.e. chopping-up of the floor and anchorage and embedment of the grooves, is time-consuming and costly; it can take weeks.

One object of the present invention is therefore to provide a straightening arrangement which is less complicated to use and also quicker and cheaper to set up.

It is more particularly an object of the invention to provide a straightening arrangement which is flexible and versatile and which can be installed quickly and effectively and which, moreover, can be moved and reinstalled elsewhere.

It is a further object of the invention to provide a straightening arrangement which does not take up space when not in use, allowing the workshop floor to be used for other things.

These objects, inter alia, are achieved by means of straightening arrangements and processes according to the appended patent claims.

According to one aspect of the invention, a straightening bench arrangement is provided, for straightening a chassis frame which is bent in the lateral or vertical direction or is crooked. The arrangement comprises a plurality of bridges which can be detachably anchored to a floor or a floor rail or beam arranged on the floor, each of the bridges comprising a beam construction, preferably comprising a horizontal beam and a vertical beam whose lower end is fixed to the horizontal beam, a nose fastening or other anchoring device, a construction arranged horizontally on the beam construction, as well as a chain attachment fitting, each bridge being transportable as a unit, and the floor anchorage being detachably lockable to the floor or to the floor rail or beam in two directions, which are perpendicular to one another and also to the extent of the chassis frame.

The horizontally arranged construction of each bridge, which can be a device for linear mechanical work such as a hydraulic cylinder, is arranged, in the straightening of a chassis frame which is bent in the lateral direction, to apply a horizontally directed linear force to the chassis frame, whilst its chain attachment fitting is arranged, in the straightening of a chassis frame which is bent in the vertical direction or is crooked, to hold a chain that is fixed to the chassis frame.

The straightening arrangement can also comprise two devices for linear mechanical work in the vertical direction, preferably two vertically arranged hydraulic cylinders, which are used to apply vertically directed linear forces to the chassis frame in the straightening of a chassis frame which is bent in the vertical direction or is crooked.

The straightening arrangement can also comprise the floor rail or beam, as well as floor anchorages for detachably anchoring the floor rail or beam to a floor.

One advantage of the invention is that the setting-up of the straightening arrangement according to the present invention is simple, quick and thus cheap, since the bridges do not need to be assembled and dismantled for each new type of straightening. Each of the bridges can, without modification, be used in respect of all three main types of damage in which the methodology and the equipment according to the prior art differ: lateral bending, vertical bending and crookedness.

According to another aspect of the invention, a process for setting up a straightening arrangement for straightening a bent or crooked chassis frame is provided, comprising the steps that holes are made in a floor, optionally a centre beam is detachably fastened to the floor by means of floor anchorages which are mounted in the holes, a vehicle having a bent or crooked chassis frame is arranged on the floor, and a plurality of straightening devices are detachably fastened to the floor by means of floor anchorages which are mounted in chosen holes, or optionally to the centre beam at chosen positions along the same.

Some advantages with a centre beam which is detachably fitted in place on the floor, and with bridges directly anchored on the floor compared with traditional arrangements such as embedded floor grooves, are that the installation time is extremely short—a day or so's shutdown for drilling of holes and fitting of floor anchorages, compared with chopping-up of the floor and embedment of grooves, which can take several weeks. The cost of installing floor anchorages is essentially much lower than the cost of embedding floor grooves. Compared with fixed ramp installations, the present invention allows the floor space to be used for other things when straightening is not being carried out. Furthermore, workshops which rent their premises can easily restore the floor after them when they move and take their floor anchorages with them to their next premises.

BRIEF DESCRIPTION OF THE DRAWINGS

The invention is described in greater detail below with reference to FIGS. 1-7, which are shown merely to illustrate the invention and will not therefore limit the same in any way.

DETAILED DESCRIPTION OF EMBODIMENTS

Figure 1A:
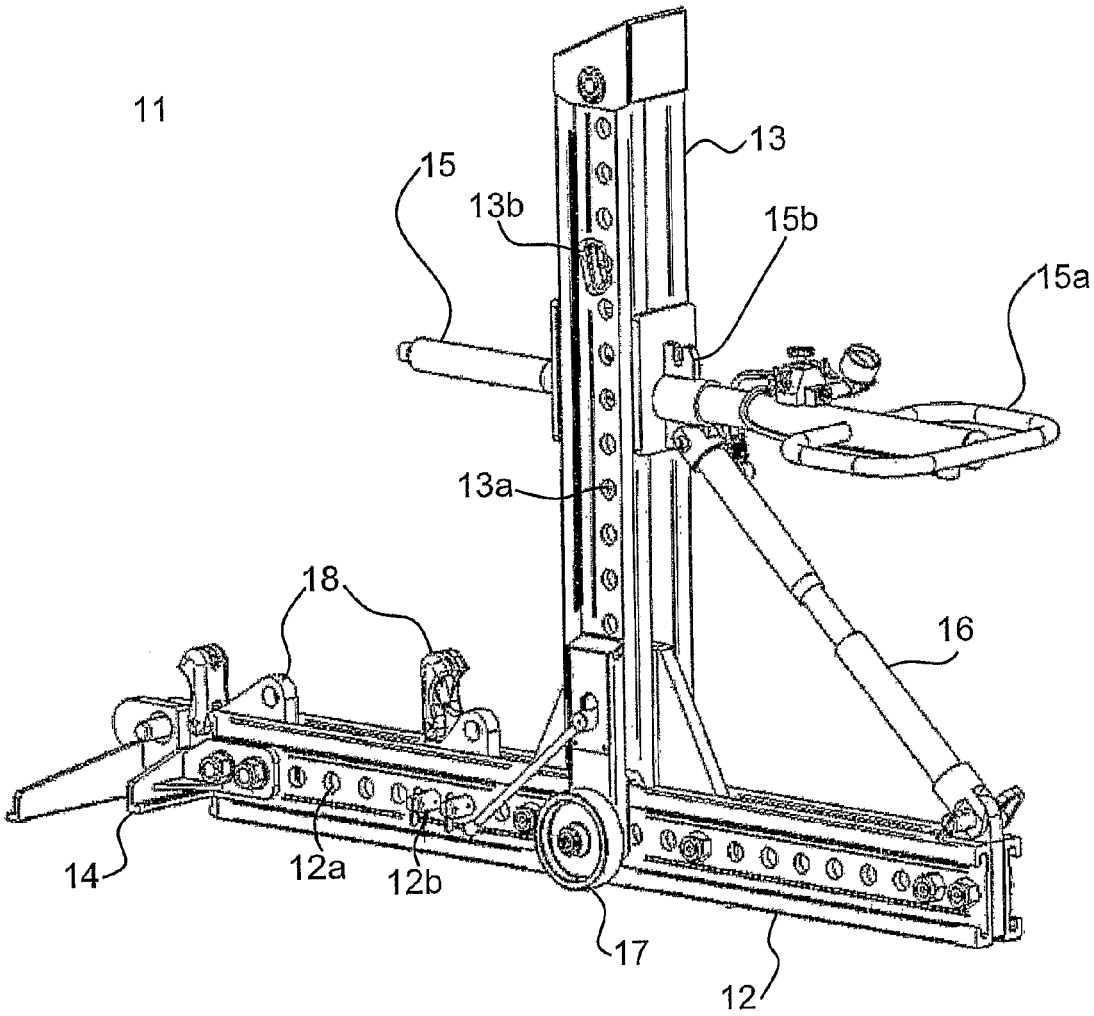
FIGS. 1*a-b* show in different perspective views a bridge which forms part of a straightening arrangement according to one embodiment of the present invention.
Figure 1B:
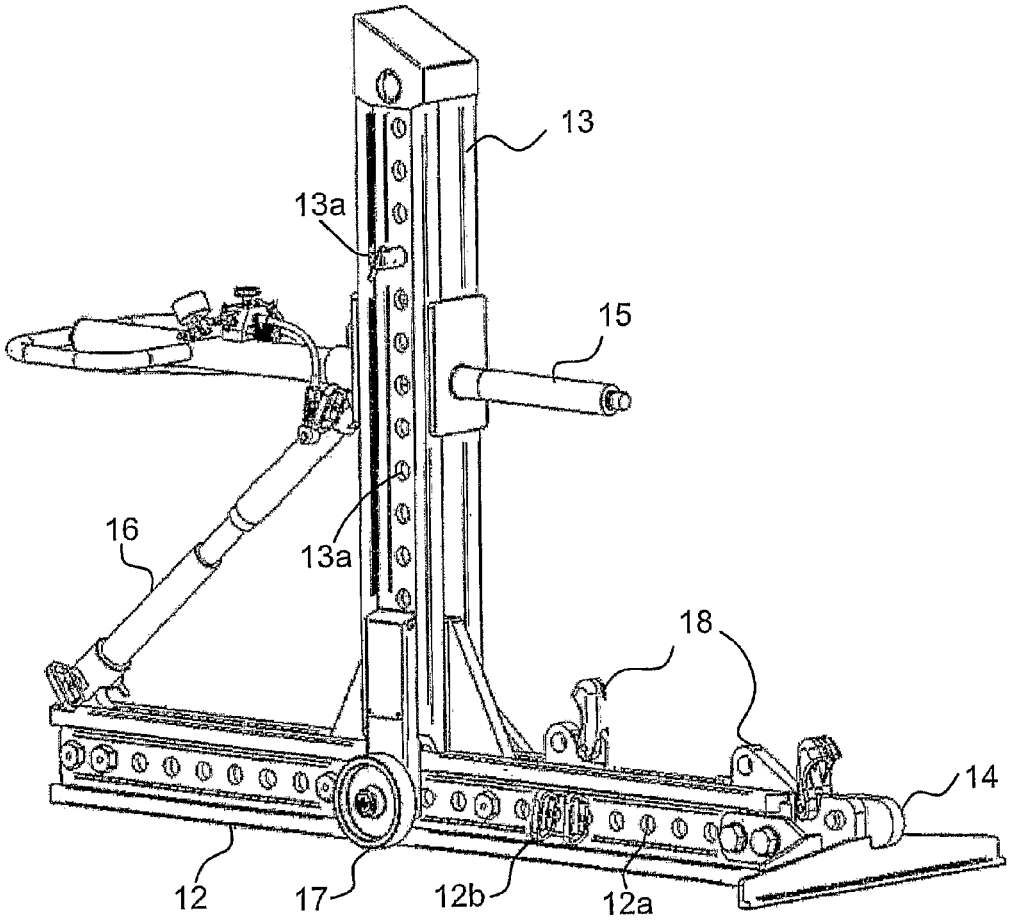

According to one embodiment of the invention, a straightening arrangement for straightening a chassis frame which is bent in the lateral or vertical direction or is crooked comprises a plurality of bridges, one of which is shown in FIGS. 1*a-b*.

Each bridge 11 comprises a horizontal beam 12, a vertical beam 13 whose lower end is fixed to the horizontal beam 12, a nose fastening 14 on the front end of the horizontal beam 12, and a device 15 arranged horizontally on the vertical beam 13. This device 15 can be a device for linear mechanical work, preferably a horizontally arranged hydraulic cylinder, or quite simply a rigid beam or bar to constitute a counterstay when force is applied during straightening.

In alternative embodiments, the bridge 11 can comprise a different-looking beam construction, for example comprising two criss-crossing beams.

At least one of the bridges comprises a device for linear mechanical work in the horizontal direction, whilst other bridges can comprises a beam or bar for providing a passive counterstay during straightening. Each hydraulic cylinder 15 can be connected to a pressure source so as to be able to convert hydraulic pressure into linear mechanical work.

One advantage of each bridge comprising a device for linear mechanical work in the horizontal direction is that only one type of bridge needs to be constructed. Furthermore, the bridges are then exchangeable and a bridge which is required for active force application, in which the device for linear mechanical work does not work properly in some respect, can be exchanged for another bridge which is only required for passive force application, i.e. as a counterstay.

Furthermore, the horizontally arranged device 15 of each bridge 11 can preferably be fastened to the vertical beam 13 at a chosen height of an endless number of optional heights. This is expediently achieved by the vertical beam 13 being provided with a number of holes 13*a* along the extent of the vertical beam 13 and by the horizontally arranged device 15 being provided with a hole alignable with the holes 13*a* of the vertical beam 13. A locking pin or bolt 13*b* locks the horizontally arranged device 15 at a suitable height.

Each bridge 11 can further comprise a device 16 for linear mechanical work, preferably a hydraulic cylinder, arranged to transport the horizontally arranged device 15 in the vertical direction along the vertical beam 13 in order thereby to discharge the operator from manual lifting/lowering of the horizontally arranged device 15.

Figure 2:
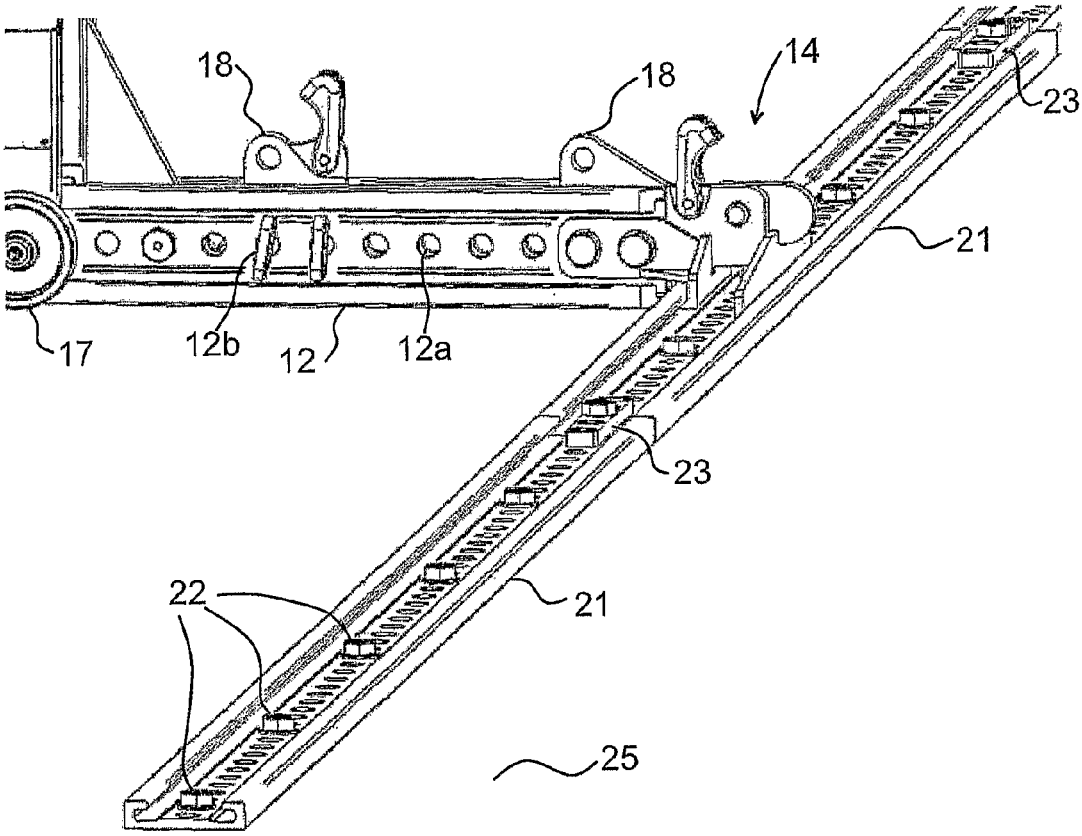
FIG. 2 shows in perspective view a detail of the bridge in FIGS. 1*a-b*, mounted on a centre beam.
Figure 3:
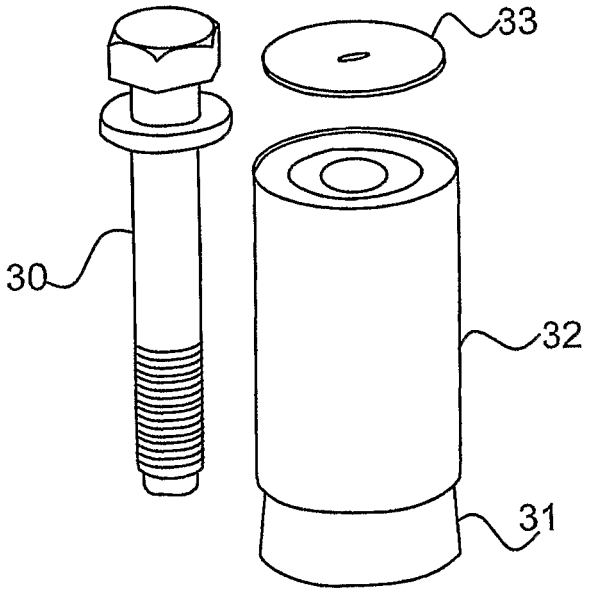
FIG. 3 shows in perspective view a floor anchorage for anchoring the centre beam to a floor.

The nose fastening 14 of each bridge can be detachably fastened to a profiled and perforated floor rail or beam 21, which is illustrated in FIG. 2. The floor rail or beam 21 is detachably anchored to a floor 25 by means of floor anchorages, preferably containing expansion bolts 22 which are mounted in holes made in the floor 25. In FIG. 3, such an expansion bolt is shown in detail, comprising a bolt 30, a part 31 which is conically shaped at one end and is threaded at an opposite end, an outer, slotted tube 32 and a cap 33. In the assembly operation, the cone 31 and the tube 32 are arranged in a hole in the floor and are fitted in place with a purpose-built tool. The slots of the tube 32 are thereby forced outwards and the floor anchorage is locked in the floor. The floor rail or beam 21 is arranged above with one of its holes aligned with the floor hole, the bolt 30 being screwed from above into the cone 31. The slots of the tube 32 are thereby forced outwards and the expansion bolt locks the rail to the floor.

The floor rail or beam 21 is preferably constituted by an aluminium profile and can be cut to the desired length or extended by the addition of one or more extension washers 23. This makes the system very flexible and enables it to be adjusted to the requirements of the particular workshop.

Figure 4A:
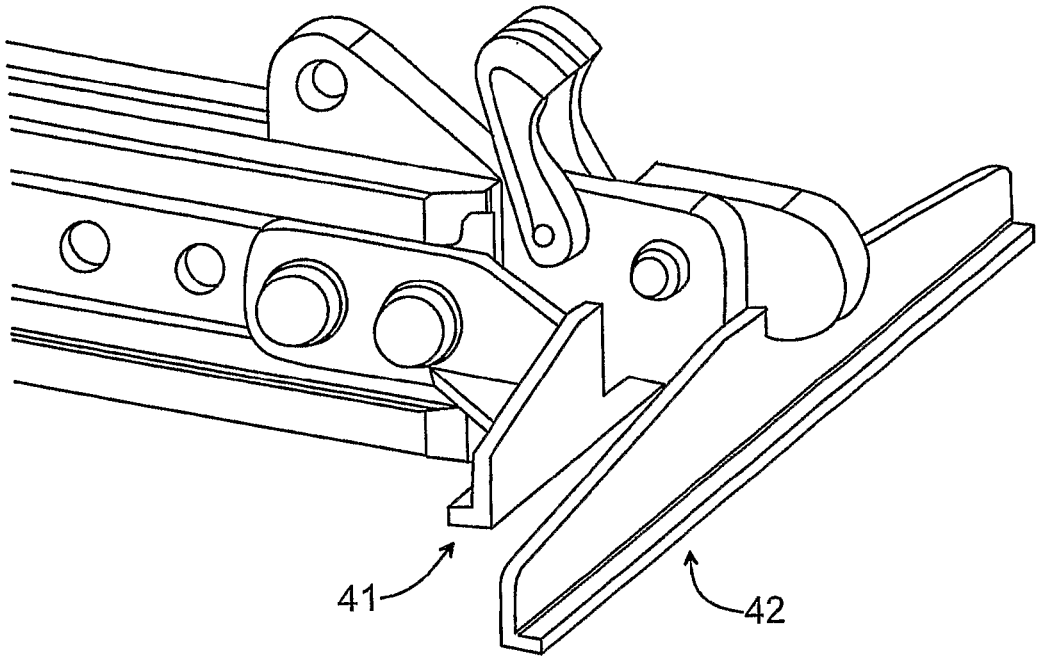
FIGS. 4*a-b* show in perspective views a nose fastening forming part of the bridge in FIGS. 1*a-b*, as well as a detail thereof.
Figure 4B:
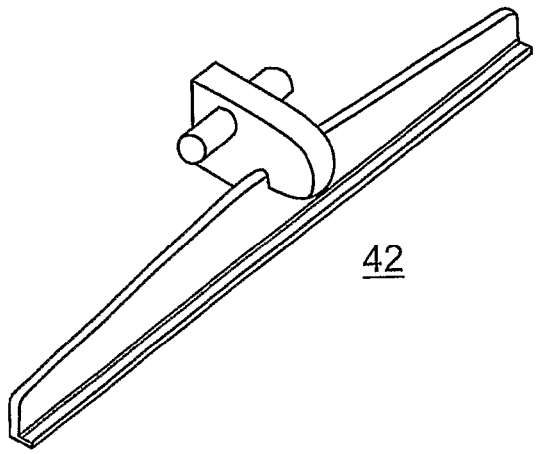

The nose fastening 14 of each bridge comprises a rear nose fastening 41 and a front nose fastening 42, as is shown in detail in FIG. 4. The front nose fastening 42 can be detachably fastened to the bridge 11 and is shown separately in FIG. 4*b*.

In the assembly operation, the rear nose fastening 41 is brought into engagement with a part/profile part of the profiled floor rail or beam 21 by quite simply hooking the rear nose fastening into that profile of the floor rail or beam 21 which lies closest to the bridge 11. After this, the front nose fastening 42 is brought into engagement with another, opposite part/profile part of the profiled floor rail or beam 21 and is fastened to the bridge with a bolt, cotter pin or the like. In this case, the bridge 11 is locked in two directions, which are perpendicular to one another and also to the extent of the floor rail or beam 21.

Each bridge 11 further comprises one or more chain attachment fittings 18 mounted on the horizontal beam between the nose fastening 14 and the lower end of the vertical beam 13. These chain attachment fittings 18 can be fittable at any chosen positions of an endless number of optional horizontal positions along the horizontal beam 12. For this purpose, the horizontal beam 12 comprises a number of holes 12*a* along the extent of the horizontal beam 12 and the chain attachment fittings 18 comprise holes alignable with the holes 12*a* of the horizontal beam 12. A locking pin or bolt 12*b* locks the chain attachment fittings 18 in chosen positions. Similarly, the vertical beam 13 can also be movably and detachably fastened to the horizontal beam 12 at a chosen position of an endless number of optional horizontal positions along the horizontal beam 12. It is important, however, that the beams 12, 13 are configured with suitable anchoring constructions, such that they can be easily locked together and, moreover, can withstand large forces/loads.

Each bridge can further be provided with a chain attachment fitting 15*b* arranged on or around the horizontally arranged device 15, as well as with wheels 17 so that the bridge can be easily transported/rolled as a unit when a straightening arrangement is being set up for a specific application.

The straightening arrangement can also comprise devices for linear mechanical work in the vertical direction, preferably vertically arranged hydraulic cylinders, as will be described further below.

The straightening arrangement according to the present invention is flexible and versatile and can without modification be used in respect of all three main types of damage in which the equipment according to the prior art differs: a chassis frame bent in the lateral direction, a frame bent in the vertical direction and a crooked frame.

Below and with reference to FIGS. 5-7, a more detailed description is provided of how the straightening arrangement according to one embodiment of the present invention is set up to straighten chassis frames having the three main types of damage.

Figure 5:
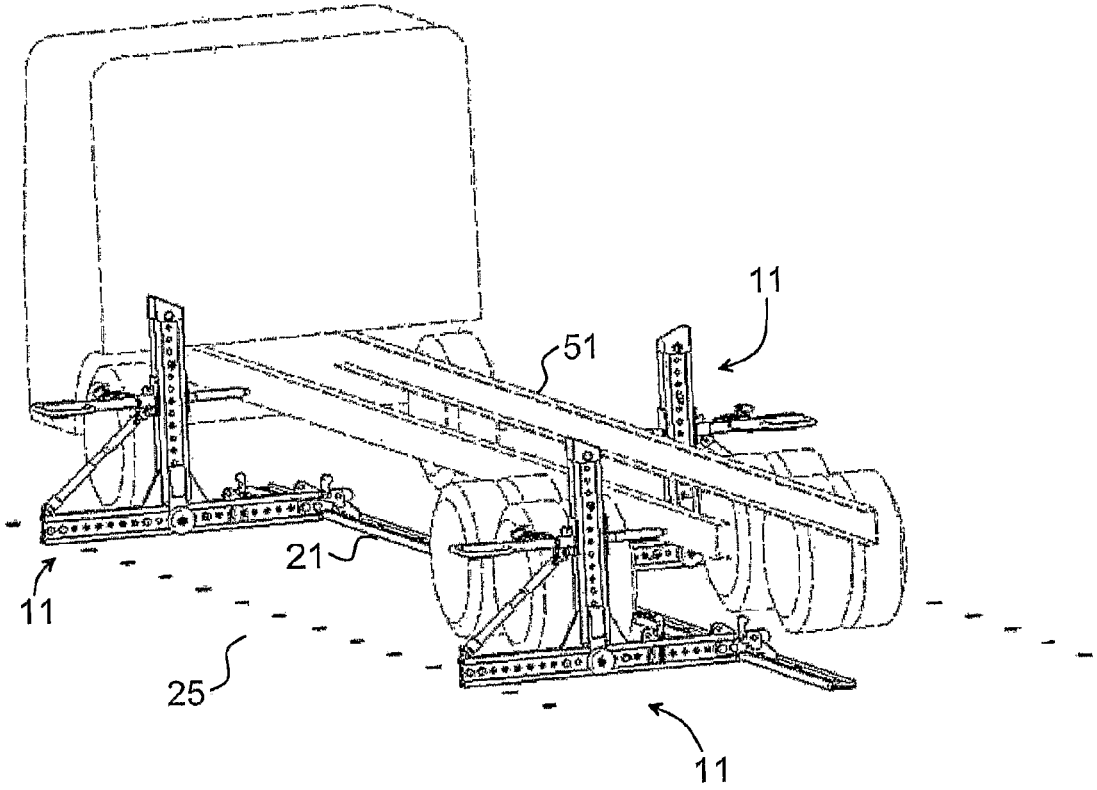
FIG. 5 shows in perspective view a straightening arrangement according to one embodiment of the present invention, configured for straightening of a chassis frame bent in the lateral direction.

FIG. 5 shows in perspective view the straightening arrangement configured for straightening of a chassis frame 51 bent in the lateral direction. Three bridges 11 are transported up to suitable positions along the floor rail or beam 21. Typically, a bridge 11 is arranged in the middle of the convex side of the bent chassis frame 51 and a bridge 11 is arranged at each end of the concave side of the bent chassis frame 51. Typically, the centremost bridge is used to apply a horizontally directed force to the chassis frame 51 by means of a device for linear mechanical work, whilst the two bridges on the concave side act merely as counterstays. Thus, in this example, one bridge having a device for linear mechanical work would suffice, the two other bridges being able to have a horizontally arranged device in the form of a rigid bar or beam.

Figure 6:
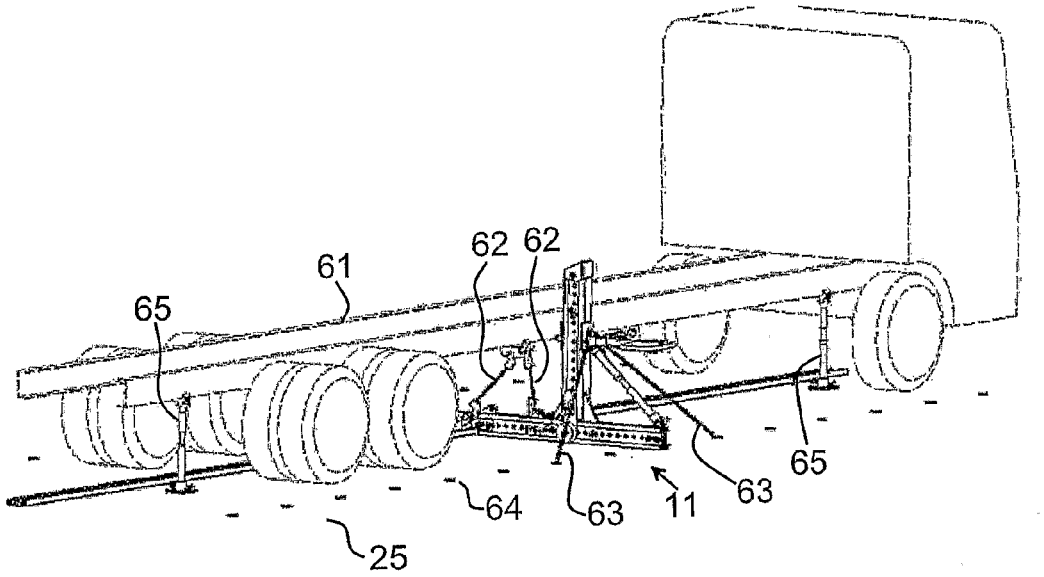
FIG. 6 shows in perspective view a straightening arrangement according to one embodiment of the present invention, configured for straightening of a chassis frame bent in the vertical direction.

FIG. 6 shows in perspective view the straightening arrangement configured for straightening of a vertically bent chassis frame 61 oriented with the convex side upwards. A bridge 11, and two devices 65 for linear mechanical work in the vertical direction, preferably two vertically arranged hydraulic cylinders, are transported up to suitable positions along the floor rail or beam 21. Typically, the bridge 11 is arranged around the centre point of the bent chassis frame 61 and a device 65 for linear mechanical work in the vertical direction is arranged at each end of the bent chassis frame 61. Typically, the bridge 11 is used as a counterstay in the downward direction for the bent chassis frame 61, whilst the two devices 65 for linear mechanical work in the vertical direction apply upwardly directed forces to the chassis frame 61 at its ends.

The bridge 11 is set up for such a counterstay function by fixing one or more chains 62 to the bent chassis frame 61, tensioning these and fixing them in one of the chain attachment fittings 18. In addition, one or more chains 63 is/are anchored in holes 64 in the floor 25 by means of, for example, expansion bolts, whereupon the chains are tensioned and fixed in the chain attachment fitting 15*b*. In this example, the bridge 11 does not therefore need to have a device for linear mechanical work.

It should be noted that if a chassis frame bent in the vertical direction is orientated with the convex side downwards, bridges according to the above are arranged on the ends of the chassis frame and a device for linear mechanical work in the vertical direction according to the above is arranged between the bridges.

Figure 7:
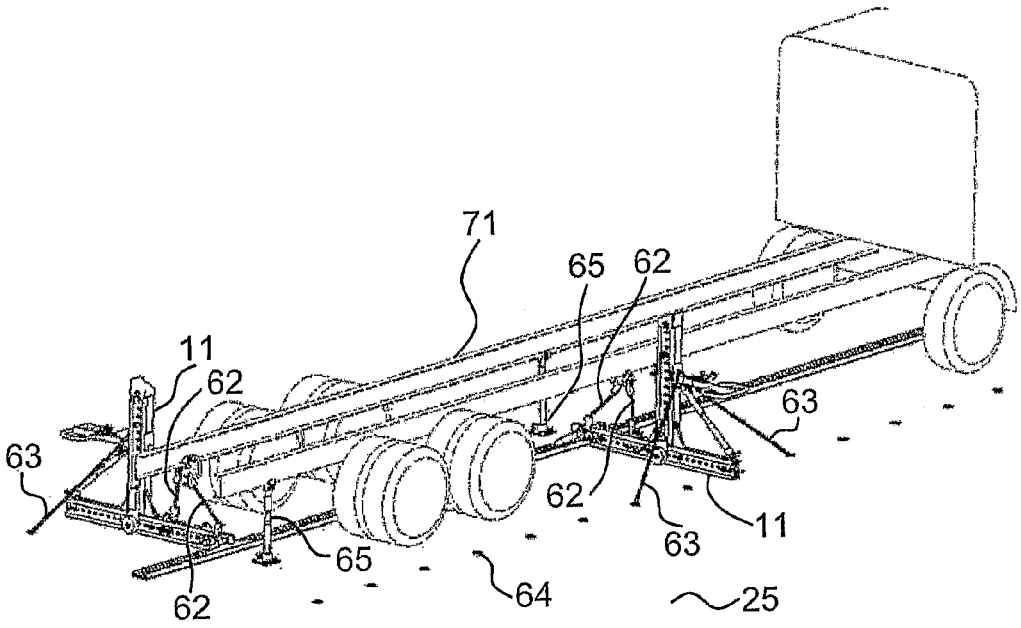
FIG. 7 shows in perspective view a straightening arrangement according to one embodiment of the present invention, configured for straightening of a crooked chassis frame.

FIG. 7 shows in perspective view the straightening arrangement configured for straightening of a crooked chassis frame 71. This differs from the configuration in FIG. 6 by virtue of the fact that two devices 65 for linear mechanical work in the vertical direction are arranged in diagonally opposite corners of or positions on the crooked chassis frame 71, whilst two bridges 11 configured according to the bridge in FIG. 6 are arranged in diagonally opposite corners of or positions on the crooked chassis frame 71. The exact positioning of the devices 65 for linear mechanical work in the vertical direction and of the bridges 11 depends on the crookedness of the chassis frame.

It should be noted that the straightening arrangement having the flexible and versatile bridges according to the present invention can be used together with floor rails or beams other than those described in the present description. It should especially be recognized that it can be used together with embedded grooves or rails of the kinds which are known per se. They can also be fitted directly in the floor with above-described floor anchorages.

It should further be noted that the invention comprises a process for setting up a straightening arrangement for straightening of a bent or crooked chassis frame, as well as a straightening arrangement of the kind which, per se, is not limited to the above-described straightening arrangement comprising the flexible and versatile bridges. It should especially be recognized that they can include bridges and straightening devices which are assembled and dismantled after each straightening.

The process for setting up a straightening arrangement comprises the steps that holes are made in a floor, a centre beam is detachably fastened to the floor by means of floor anchorages, preferably expansion bolts, which are mounted in the holes made in the floor, a vehicle having a bent or crooked chassis frame is arranged over the centre beam, and a plurality of straightening arrangements are detachably fastened to the centre beam at chosen positions along the centre beam.

The arrangement comprises a centre beam, floor anchorages, especially expansion bolts, for detachably anchoring the floor beam to a floor, and a plurality of straightening devices which can be detachably fastened to the centre beam at chosen positions along the centre beam.

Alternatively, a plurality of straightening devices are detachably anchored to a floor by means of floor anchorages. Preferably, the straightening devices are anchored in chosen positions of an endless number of possible positions, i.e. holes made in the floor.

Of course, the present invention as herein described is not limited to the above-described embodiments shown in the drawings, but can be modified within the scope of the appended patent claims.

The invention claimed is:

1. Straightening arrangement for straightening a chassis frame which is bent in the lateral or vertical direction or is crooked, the straightening arrangement comprising a plurality of bridges detachably anchored to a floor, each of the bridges comprising:

a beam construction, the beam construction comprises a horizontal beam and a vertical beam whose lower end is non-pivotally fixed to the horizontal beam, a first device arranged horizontally on the vertical beam and traversing the vertical beam in a direction parallel to the horizontal beam, wherein the first device is fastened to the vertical beam at a chosen one of a plurality of heights along the height of the vertical beam, a second device for linear mechanical work arranged to transport the first device in the vertical direction, and a chain attachment fitting arranged on the beam construction, wherein the bridge is transportable as a unit, the beam construction is detachably fastened to the floor, the bridge being locked in at least two directions, which are perpendicular to one another and adapted to be perpendicular to the chassis frame, wherein the first device is arranged, in the straightening of a chassis frame which is bent in the lateral direction, to apply a horizontally directed linear force to the chassis frame, and the chain attachment fitting is arranged, in the straightening of a chassis frame which is at least one of bent in the vertical direction or is crooked, to hold a chain that is fixed to the chassis frame;

a floor rail and floor anchorages for detachably anchoring the floor rail to the floor, wherein the bridges are detachably anchored to the floor rail;

wherein the floor rail is profiled and a nose fastening anchors the bridge to the profiled floor rail, the nose fastening of each bridge comprises a rear nose fastening for engagement with a portion of the profiled floor rail and a front nose fastening for engagement with another portion of the profiled floor rail where at least one of the rear and front nose fastenings is detachably fastened to the bridge.

2. Straightening arrangement according to claim 1, wherein, for each of the bridges, a nose fastening is arranged on the front end of the horizontal beam, in which the nose fastening is detachably fastened to the floor such that the bridge is locked in the two directions, wherein the nose fastenings comprise a plurality of members extending along the profiled floor rail in a direction perpendicular to the horizontal beam.

3. Straightening arrangement according to claim 2, wherein, for each of the bridges, the chain attachment fitting is arranged on the horizontal beam.

4. Straightening arrangement according to claim 3, wherein, for each of the bridges, the chain attachment fitting on the horizontal beam is mounted between the nose fastening and the lower end of the vertical beam.

5. Straightening arrangement according to claim 1, wherein the floor anchorages comprise expansion bolts, arranged to be mounted in holes made in the floor.

6. Straightening arrangement according to claim 1, wherein, for at least one of the bridges, the first device is for linear mechanical work.

7. Straightening arrangement according to claim 1, wherein, for each of the bridges, the first device is for linear mechanical work.

8. Straightening arrangement according to claim 1, wherein each of the bridges is provided with a plurality of chain attachment fittings.

9. Straightening arrangement according to claim 1, wherein each of the bridges is provided with a chain attachment fitting, which is arranged to hold a chain which is anchored between the chain attachment fittings and the floor and locks the bridge to the floor in a rear portion thereof.

10. Straightening arrangement according to claim 1, wherein each of the bridges is provided with wheels to enable it to be transported as a unit.

11. Straightening arrangement according to claim 1, comprising three of the bridges arranged in a configuration for the straightening of the chassis frame bent in the lateral direction.

12. Straightening arrangement according to claim 1, further comprising at least one of the plurality of bridges and two linear mechanical work members oriented in the vertical direction for the straightening of a chassis frame bent in the vertical direction.

13. Straightening arrangement according to claim 1, further comprising at least two of the plurality of bridges and two linear mechanical work members oriented in the vertical direction, arranged in a configuration for straightening of the chassis frame where the chassis frame is crooked.

14. Straightening arrangement for straightening a chassis frame which is bent in the lateral or vertical direction or is crooked, the straightening arrangement comprising one or more bridges detachably anchored to a floor, each of the bridges comprising:

a beam construction, the beam construction comprising a horizontal beam and a vertical beam coupled to the horizontal beam;

a first device arranged horizontally on and traversing the vertical beam, wherein the first device is slidably movable in a vertical direction on the vertical beam; and a chain attachment fitting arranged on the horizontal beam, wherein:

the bridge is transportable as a unit;

the beam construction detachably fastened to the floor of the bridge being locked in at least two directions, which are perpendicular to one another and adapted to be perpendicular to the chassis frame;

wherein the first device is arranged, in the straightening of a chassis frame which is bent in the lateral direction, to apply a horizontally directed linear force to the chassis frame, and the chain attachment fitting is arranged, in the straightening of a chassis frame which is at least one of bent in the vertical direction or is crooked, to hold a chain that is fixed only to the chassis frame and the chain attachment fitting on the horizontal beam;

for each of the bridges, the first device is fastened to the beam construction at a chosen one of multiple optional heights; and for each of the bridges, a second device for linear mechanical work is arranged to slidably move the first device in the vertical direction.

15. Straightening arrangement for straightening a chassis frame which is bent in the lateral or vertical direction or is crooked, the straightening arrangement comprising a plurality of bridges detachably anchored to a floor, each of the bridges comprising:

a beam construction wherein the beam construction comprises a first beam and a second beam;

a device arranged horizontally on and traversing the first beam; and a chain attachment fitting arranged on the second beam, wherein:

the bridge is transportable as a unit;

the beam construction detachably fastened to the floor of the bridge being locked in at least two directions, which are perpendicular to one another and adapted to be perpendicular to the chassis frame;

wherein the device is arranged, in the straightening of a chassis frame which is bent in the lateral direction, to apply a horizontally directed linear force to the chassis frame, and the chain attachment fitting is arranged, in the straightening of a chassis frame which is at least one of bent in the vertical direction or is crooked to hold a chain that is fixed to the chassis frame;

wherein each of the bridges is provided with wheels to enable it to be transported as a unit; and wherein the device is arranged horizontally on and traversing the first beam on at least one of the plurality of bridges comprises a hydraulic cylinder and the device arranged horizontally on another plurality of bridges comprises a counterstay.

* * * * *